United States Patent [19]

Babish et al.

[11] 4,091,865

[45] May 30, 1978

[54] AIR-PRESSURIZED, SAFETY ANTI-FREEZE TANK

[75] Inventors: John A. Babish, Glendora; Larry K. Arnot, Duarte; Douglas C. Appel, Glendora, all of Calif.

[73] Assignee: Wynn Oil Company, Fullerton, Calif.

[21] Appl. No.: 815,571

[22] Filed: Jul. 14, 1977

Related U.S. Application Data

[63] Continuation-in-part of Ser. No. 741,065, Nov. 11, 1976.

[51] Int. Cl.[2] ..... F28G 9/00

[52] U.S. Cl. ..... 165/95; 123/41.55; 137/209; 222/396

[58] Field of Search ..... 123/41.14, 41.01, 41.55; 137/209; 222/396, 394; 165/95

[56] References Cited

U.S. PATENT DOCUMENTS

| | | | |
|---|---|---|---|
| 1,139,353 | 5/1915 | Ellis | 222/396 |
| 1,223,047 | 4/1917 | Heitz | 222/396 |
| 2,222,516 | 11/1940 | Powell et al. | 134/169 A X |
| 2,520,175 | 8/1950 | Socbe | 222/396 X |
| 2,681,657 | 6/1954 | Griffith, Jr. | 134/98 |
| 3,115,145 | 12/1963 | Monteath, Jr. | 134/98 X |
| 3,409,218 | 11/1968 | Moyer | 165/95 X |

*Primary Examiner*—Albert W. Davis, Jr.
*Attorney, Agent, or Firm*—William W. Haefliger

[57] ABSTRACT

A coolant container assembly is especially designed for use with an internal combustion engine cooling system together with means to produce a pressurized flow of flushing liquid to flush the system, such means including a source of pressurized gas such as air. The assembly includes:

(a) a coolant liquid container operatively connectible to said source of pressurized gas via a pressure regulator, (b) the container having an inlet to pass said gas into the container to pressurize coolant therein, (c) there being a flow restrictor connected in series with said inlet to limit the rate of gas flow into the container thereby to inhibit inadvertent bursting of the container, and (d) the container having an outlet communicable with said cooling system to pass pressurized coolant solution thereto.

8 Claims, 3 Drawing Figures

AIR-PRESSURIZED, SAFETY ANTI-FREEZE TANK

BACKGROUND OF THE INVENTION

This application is a continuation-in-part of our prior application Ser. No. 741,065, filed Nov. 11, 1976, and entitled "Engine Cooling System Flushing Apparatus and Method".

This invention relates generally to flushing of internal combustion engine liquid cooling systems; more particularly, it concerns air or gas pressure assisted introduction of anti-freeze solution into such cooling systems. Such air pressure derived from the flushing equipment.

Studies show that over-heating is a major cause of vehicle breakdowns on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break-off, and engine blocks can become distorted or crack. Accordingly, there has arisen a need for efficient engine cooling system flushing methods and apparatus. U.S. patent application Ser. No. 741,065 describes flushing procedure and apparatus characterized as overcoming the problems discussed above and the disadvantages of prior flushing techniques. Such apparatus employs the combined forces of controlled pressurized water and air turbulence to effect efficient flushing and cleaning of internal combustion engine liquid cooling systems including both the horizontal and vertical flow types. The fundamental method employs steps that include:

(a) providing a controlled pressurized flow of flushing liquid and entrained gas (air) bubbles,
(b) and passing said flow alternately through
  (i) the radiator in a reverse direction,
  (ii) the engine coolant passages in a reverse direction,
  (iii) the radiator in a forward direction,
  (iv) the engine coolant passages in a forward direction.

The flow may also pass through the water pump in said reverse direction, the heater and water pump in the reverse direction, the water pump in the forward direction, and the heater and water pump in the forward direction. Also described in that application is the selective use of the air pressure source employed in the flushing cycle to effect positive displacement of the final flush water thereby partially evacuating the system to allow for the addition of the vehicle manufacturer's recommended amount of winter/summer coolant. Further described is the selective use of the air pressure source employed in the flushing cycle to effect positive displacement of the winter/summer coolant solution into the cooling system; however, certain problems then arise. For example, if the antifreeze solution is carried in a lightweight tank or container, the introduction of air pressure can result in bursting of the tank. This can happen even if a safety valve is used on the tank to release excess pressure, since the pressure build-up can be so sudden as to fracture the tank before the valve can release the rapid pressure build-up. While a pressure regulator can be employed to control the pressure introduced to the tank, the problem remains, and especially in the event of malfunctioning of the regulator.

SUMMARY OF THE INVENTION

It is a major object of the invention to provide apparatus overcoming the above problems and deficiencies, and enabling the safe use of lightweight, as for example, plastic, tanks to contain winter/summer coolant liquid to be displaced by gas pressure into engine cooling systems. Basically, the apparatus comprises:

(a) a coolant liquid container operatively connectible to the source of pressurized gas via a pressure regulator and valve,
(b) the container having an inlet to pass the gas into the container to pressurize coolant liquid therein,
(c) a flow restrictor connected in series with the inlet to limit the rate of gas flow into the container which in turn corresponds to the release capabilities of the safety pop-off valve, thereby to inhibit over pressurization and inadvertent bursting of the container, and
(d) the container having an outlet communicable with the cooling system to pass pressurized coolant liquid thereto.

As will appear, the coolant may be for both winter and summer use, the gas pressure flow restrictor may advantageously include tubing having a reduced bore to provide an orifice that limits the inflow rate of pressurized gas to correlate with the release capabilities of the safety valve thereby preventing tank over pressurization and resultant bursting. The restrictor tubing is typically carried by a fitting attached to the container, in a simple, advantageous manner, and in proximity to the safety valve.

Further, the tank may be carried by or attached to a console used for controlling the flushing of the cooling system, and at which air pressure control valving and regulator means is located.

These and other objects and advantages of the invention, as well as the details of an illustrative embodiment, will be more fully understood from the following description and drawings, in which:

DRAWING DESCRIPTION

DETAILED DESCRIPTION

Figure 1:
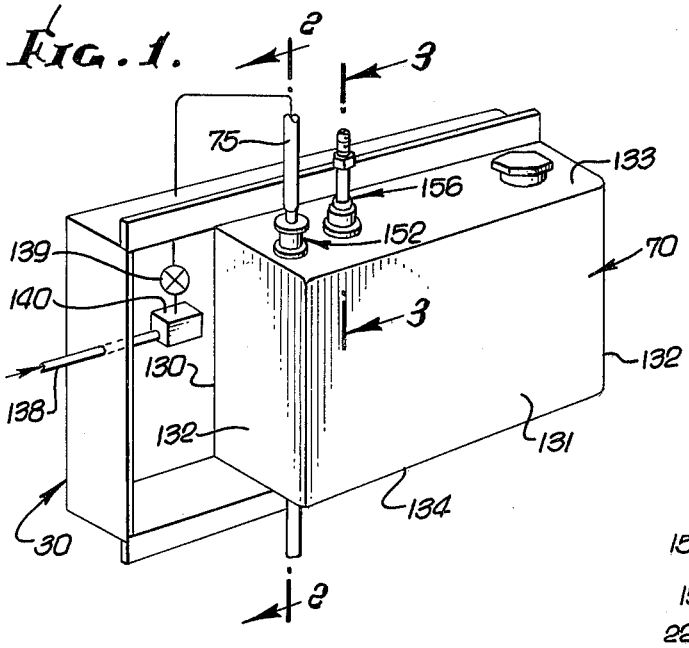
FIG. 1 is a perspective view of apparatus incorporating the invention.

In the drawings, a winter/summer coolant container or tank 70 is shown to have front and rear walls 130 and 131, side walls 132, and top and bottom walls 133 and 134. The container advantageously consists of plastic material, as for example, ultraviolet protected polyethylene, or other formable material with a wall thickness of between about one-quarter and three-eighths inches. The container is intended to be used in refilling an internal combustion engine cooling system with winter/summer coolant as represented at 136, and with means to produce a pressurize flow of coolant to fill the cooling system. Such means may be associated with or carried by or within a console indicated at 30 and may include a source of pressurized gas, such as air, indicated at 138. A more complete description of such means is given in U.S. patent application Ser. No. 741,065 entitled, "Engine Cooling System Flushing Apparatus and Method". Further such means typically includes apparatus to mix pressurized liquid and air for selective delivery to different portions of the engine cooling system, such as the radiator, heater, and engine block, as described in said application. For the purpose of this invention, such means will be understood as associated with console 30.

FIG. 1 shows the container 70 operatively connected to source 138 via a gas (or air) pressure regulator 140 and a valve 139. The tank has an inlet 141 to pass pressure regulated gas to the container interior 142, to pressurize winter/summer coolant liquid, such as glycol indicated at 143. Such pressurization drives the glycol through container bottom outlet 144, via fitting 145, check valve, shut off valve, connecting heater hose tee and to the cooling system 136, via hose 73. Accordingly, rapid and positive filling of the system with a pre-measured amount of winter/summer coolant solution is assured and additional water previously in that system which was not removed during the standard drain cycle may thereby be driven out, as via a drain at 34*a*, depending on cooling system configuration.

Fitting 145 may include the tubular part 145*a*, flanged at 147 to abut the bottom wall 134, and interiorly threaded at 148. The exterior of part 145*a* may be suitably bonded or otherwise joined to wall 134. A second tubular part 145*b* of the fitting is exteriorly threaded at 149 to connect to thread 148, and has serrations 150 to tightly fit the flexible tubing 73.

Figure 2:
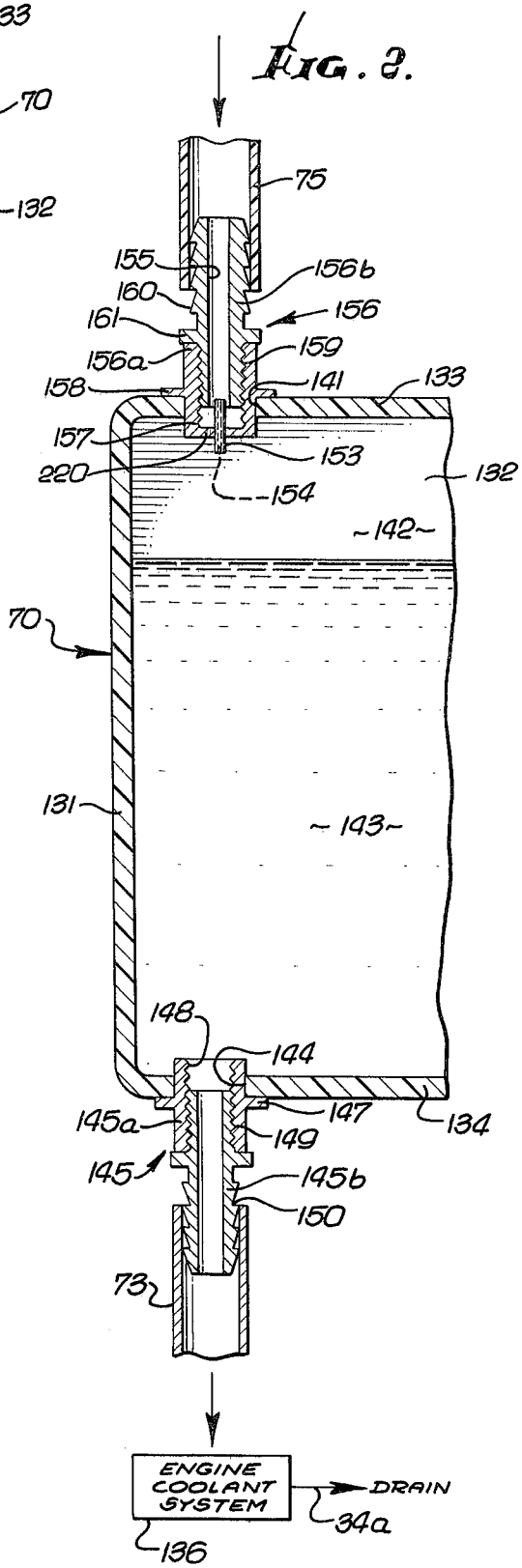
FIG. 2 is an enlarged fragmentary section, taken in elevation, on lines 2—2 of FIG. 1.
Figure 3:
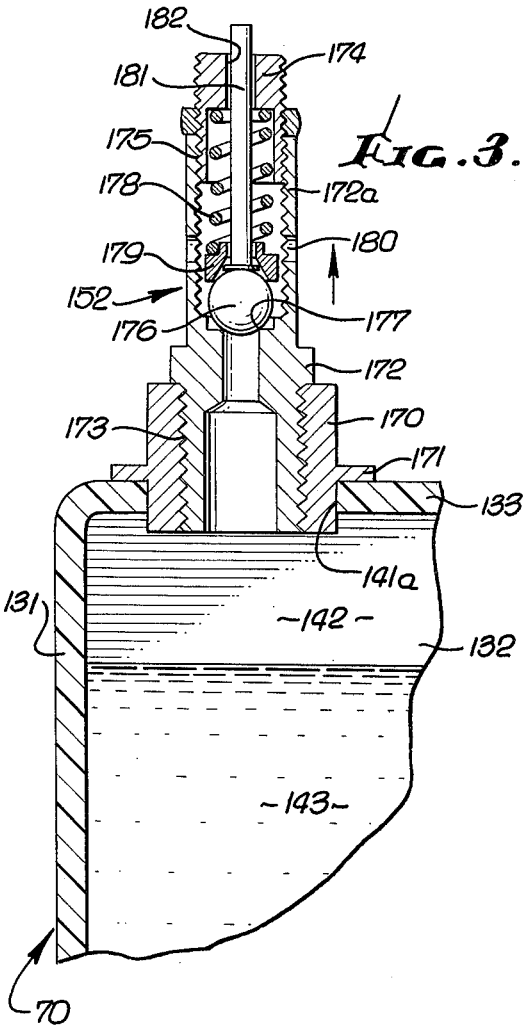
FIG. 3 is an enlarged fragmentary section, taken in elevation on lines 3—3 of FIG. 3.

In accordance with the invention, a flow restrictor is connected in series with the tank inlet, to limit the rate of pressurized gas flow into the tank, to correlate with the release capabilities of the safety valve, so as to inhibit inadvertent bursting of its wall or walls. This could otherwise occur upon a malfunction of the regulator 140 whereby a high pressure surge of gas or high volume flow of gas might suddenly enter the tank. Such bursting could occur despite use of the safety valve, generally indicated for example at 152, and which is also used to release pressure above a pre-set upper limit. As shown in FIG. 2, the restrictor 153 is in the form of tubing having a reduced bore, and is centrally inserted into the predrilled bottom membrane 220 of element 156*a*. Fitting 156 includes tubular element 156*a* projecting at 157 into the container and received in opening 141; also, element 156*a* carries a flange 158 abutting the container upper wall 133 and bonded thereto. Element 156*a* is interiorly threaded at 159 to receive exteriorly threaded fitting part 156*b* which defines a bore 155. Part 156*b* carries a flange 161 that abuts the upper end of element 156*a* and is exteriorly serrated at 160 to tightly and sealingly receive the end of hose 75. Typically, the restrictor 153 limits the inflow rate of compressed air to between 0.3 and 0.37 CFM, when the pressure in lines 75 is between 10 psi and 50 psi, respectively.

The safety valve 152 is shown to include an outer tubular fitting 170 received in top wall opening 141*a*; a flange 171 on fitting 170 and bonded to the top wall; an inner tubular part 172 received in outer fitting 170 and connected thereto at threads 173, and a tubular cap 174 thread connected to fitting 172 at 175. A check valve in the form of a ball 176 is received in fitting 172, and held against seat 177 by coil spring 178. The latter is retained between cap 174 and a ring 179 engaging ball 176. When pressure in the tank exceeds a predetermined limit, the ball is urged upwardly to compress spring 178, and excess pressure bleeds to atmosphere via side ports 180 in wall 172*a* of fitting 172. Such ports are fixed in size to correlate their excess gas release capabilities with the maximum amount of gas which can enter the system through the restrictor, with the regulator set at maximum pressure, thereby avoiding over pressurization and tank bursting. Further, the CFM flow characteristics of the restrictor 153 being correlated with the safety valve release capabilities of holes 180 avoids over pressurization and tank bursting should regulator 140 fail, exposing tank 70 to unregulated gas pressure such as that as may be found where the flushing apparatus may be installed. Note guide stem 181 actuated by the ball and projecting upwardly in guide bore 182 in cap 174. The upper end of the stem is visible, so that the user may know when it is distended, i.e. when the pressure has become excessive in the tank, allowing him to take remedial action, as for example replacing the regulator 140.

A recommended setting for the spring tension, as adjusted by rotation of cap 174, is such as to allow escape of air or gas in the tank at above about 5 psi above atmospheric pressure.

The optimum orifice diameter of the flow restrictor tube bore 154 is about 0.054 inches.

We claim:

1. For use in combination with an internal combustion engine cooling system and means to produce a pressurized flow of flushing fluid to flush said system, said means including a source of pressurized gas, the improvement assembly comprising (a) a coolant fluid container consisting of plastic material operatively connectible to said source of pressurized gas via a pressure regulator, and tubing downstream of said regulator, (b) the container having an inlet to pass said gas into the container to pressurize coolant therein, (c) there being a flow restrictor means in the tubing and connected in series with and located proximate to said inlet to limit the rate of gas flow into the container thereby to inhibit inadvertent bursting of the container, (d) the container having an outlet communicable with said cooling system to pass pressurized coolant solution thereto, (e) and a safety valve connected to said tank to release excessive pressure therein, said valve located in such proximity to said inlet, and said flow restrictor means sized in such relation to the volumetric release capacity of said safety valve, as to prevent excess insurging of gas flow into the container that would raise the pressure therein to burst levels, (f) the restrictor means defining a reduced bore that limits the inflow of pressurized gas to about the same CFM rates when the pressure in said tubing varies between 10 and 50 psi.

2. The assembly of claim 1 wherein said plastic material consists of ultraviolet protected polyethylene.

3. The assembly of claim 1 wherein the restrictor means includes a small duct in the tubing interior.

4. The assembly of claim 3 wherein the flow restrictor duct is sized to limit the gas inflow to between about 0.3 and 0.37 CFM when said pressure in the tubing varies between 10 and 50 psi.

5. The assembly of claim 1 wherein the flow restrictor means defines a bore having a diameter of about 0.054 inches.

6. The assembly of claim 1 wherein said means to produce flow includes a console at which pressurized liquid and said pressurized gas are mixed and selectively delivered to different portions of said cooling system, said container attached to said console.

7. The assembly of claim 6 including said regulator connected in series with said restrictor means.

8. The assembly of claim 7 including said engine cooling system operatively connected to said container to receive pressurized in-feed of said coolant solution.

* * * * *